US007418932B2

(12) United States Patent
Sugie et al.

(10) Patent No.: US 7,418,932 B2
(45) Date of Patent: Sep. 2, 2008

(54) ELECTROMAGNETICALLY DRIVEN VALVE

(75) Inventors: Yutaka Sugie, Nishikamo-gun (JP); Masahiko Asano, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 103 days.

(21) Appl. No.: 11/492,872

(22) Filed: Jul. 26, 2006

(65) Prior Publication Data

US 2006/0260572 A1 Nov. 23, 2006

(30) Foreign Application Priority Data

Aug. 4, 2005 (JP) ..... 2005-227004

(51) Int. Cl.
*F01L 9/04* (2006.01)

(52) U.S. Cl. ..... 123/90.11; 123/90.15; 251/129.16

(58) Field of Classification Search ..... 123/90.15, 123/90.11; 251/129.09, 129.16
See application file for complete search history.

(56) References Cited

U.S. PATENT DOCUMENTS

| | | | |
|---|---|---|---|
| 4,924,821 | A | 5/1990 | Teerman |
| 5,772,179 | A | 6/1998 | Morinigo et al. |
| 6,427,650 | B1 | 8/2002 | Cristiani et al. |
| 6,467,441 | B2 | 10/2002 | Cristiani et al. |
| 6,505,589 | B1 | 1/2003 | Hayman et al. |
| 2001/0042532 | A1 | 11/2001 | Aichinger et al. |
| 2001/0054401 | A1 | 12/2001 | Cristiani et al. |
| 2002/0020372 | A1 | 2/2002 | Stolk et al. |
| 2002/0057154 | A1 | 5/2002 | Keck |
| 2004/0011310 | A1 | 1/2004 | Sugimoto et al. |
| 2004/0055549 | A1 | 3/2004 | Petrie |

FOREIGN PATENT DOCUMENTS

| | | | |
|---|---|---|---|
| DE | 199 55 079 | A1 | 5/2000 |
| DE | 100 25 491 A 1 | | 12/2001 |
| DE | 100 53 596 | A1 | 5/2002 |
| DE | 101 20 396 | A1 | 10/2002 |
| DE | 102 20 788 | A1 | 11/2003 |
| EP | 1 087 110 | A1 | 3/2001 |
| EP | 1152129 | A1 | 11/2001 |
| EP | 1 331 369 A11 | | 7/2003 |
| EP | 1 403 471 | A2 | 3/2004 |
| FR | 2 812 026 | | 1/2002 |
| JP | 2003056317 | A * | 2/2003 |
| JP | 2006-22776 | | 1/2006 |
| WO | WO 2006/018931 | A1 | 2/2006 |

OTHER PUBLICATIONS

Abstract, JP 2003056317 A.*
Extended European Search Report dated Dec. 12, 2006.
Chinese Language Version of Chinese Office Action, Appln. No. 200610107571.0 dated Oct. 12, 2007.
English Translation of Chinese Office Action, Appln. No. 200610107571.0 dated Oct. 12, 2007.

* cited by examiner

*Primary Examiner*—Zelalem Eshete
(74) *Attorney, Agent, or Firm*—Kenyon & Kenyon LLP

(57) ABSTRACT

An electromagnetically driven valve includes multiple valve elements that have respective valve shafts and reciprocate in a direction in which the valve shafts extend; a pivoting member that extends from a driving end, which is operatively linked with the valve shafts, to a pivoting end, and that pivots around a central axis which extends along the pivoting end; a support member that supports the valve elements; and a single push plate that drives the multiple valve elements when being pressed by the pivoting member.

19 Claims, 15 Drawing Sheets

ELECTROMAGNETICALLY DRIVEN VALVE

INCORPORATION BY REFERENCE

The disclosure of Japanese Patent Application No. 2005-227004 filed on Aug. 4, 2005 including the specification, drawings and abstract is incorporated herein by reference in its entirety.

BACKGROUND OF THE INVENTION

1. Field of the Invention

The invention relates generally to an electromagnetically driven valve. More specifically, the invention relates to a pivot-type electromagnetically driven valve that is used in an internal combustion engine, and that is driven by elastic force and electromagnetic force.

2. Description of the Related Art

An electromagnetically driven valve is described, for example, in U.S. Pat. No. 6,467,441.

U.S. Pat. No. 6,467,441 describes a pivot-type electromagnetically driven valve having a fulcrum in a disc (armature). In this electromagnetically driven valve, valves are driven by respective actuators, that is, each valve needs an actuator. This increases both the cost of producing a drive circuit and the number of components.

SUMMARY OF THE INVENTION

The invention is made in order to solve the above-described problems. It is, therefore, an object of the invention to provide an electromagnetically driven valve with reduced number of components.

A first aspect of the invention relates to an electromagnetically driven valve including multiple valve elements that have respective valve shafts and reciprocate in the direction in which the valve shafts extend; a pivoting member that extends from a driving end, which is operatively linked with the valve shafts, to a pivoting end, and that pivots around a central axis which extends along the pivoting end; a support member that supports the valve elements; and a single push plate that is pressed by the pivoting member, thereby moving the multiple valve elements. The single push plate drives two or more valve elements.

In the electromagnetically driven valve thus configured, the single push plate drives two or more valve elements. Therefore, the number of pivoting members can be reduced as compared with the case where one push plate drives only one valve element. Also, the number of coils used to drive the pivoting members can be reduced. As a result, the number of components can be reduced. In addition, the power consumption can be reduced.

A stem may be further arranged between the pivoting member and the push plate. The stem and the push plate contact each other at a spherical surface. In this case, a pressure per unit area can be reduced. Accordingly, even if the stem tilts due to presence of a clearance, the wearing-away of a portion, at which the stem and the push plate contact each other, can be reduced, resulting in enhanced durability.

The electromagnetically driven valve may further include a first urging member and a second urging member that apply urging forces to respective valve elements such that the valve elements move toward the pivoting member. The urging force of the first urging member is greater than the urging force of the second urging member. The valve element, to which the urging force is applied by the first urging member, is fixed to the push plate. In this case, because the valve element, to which the urging force is applied by the first urging member, is fixed to the push plate, a clearance is left between the other valve element and the push plate and the push plate can easily support the multiple valve elements. As a result, the valve lift amount is constant among the multiple valve elements.

The valve element, to which the urging force is applied by the second urging member, may be supported by the push plate so as to be movable with respect to the push plate in the direction in which the valve shaft extend. The valve lift amount differs between the first valve element and the second valve element. In this case, when the push plate moves to open the two valves, the valves can be opened with a time lag corresponding to the clearance left between the valve element and the push plate. Accordingly, a swirl airflow can be formed at the intake valve.

The number of urging members may be less than the number of valve elements, and the urging member may apply an urging force to the push plate such that the push plate moves toward the pivoting member. Thus, the number of urging members can be reduced. In addition, a difference in the urging force among the multiple urging members need not be taken into account, because multiple urging members need not be provided.

A pivoting joint mechanism that pivotably connects the valve shaft of at least one of the valve elements to the push plate; and a stopping portion that stops the valve opening operation of the valve shaft that is connected to the pivoting joint mechanism may be further provided. In this case, it is possible to open only the other valve. Namely, it is possible to open both of the valves, and it is also possible to open only one of the valves. In other words, whether both of the valves are opened or only one of the valves is opened can be selected. The valve opening operation can be performed based on the engine output.

A moving portion that can change the position, at which a force is transmitted from the pivoting member to the push plate, in the direction in which the multiple valves are arranged may be further provided. In this case, it is possible to change the valve-lift amount of the other valve.

The push plate may include an inserted member and an inserting member that can slide with respect to each other in the longitudinal direction. The inserted member may be connected to one of the valve element via a pivoting joint mechanism, and an inserting member may be connected to the other valve element via another pivoting joint mechanism. A locking mechanism that prevents the inserted member and the inserting member from sliding with respect to each other may be further provided. The position, at which the force is transmitted from the pivoting member to the push plate, deviates from the center of the push plate in the longitudinal direction. In this case, whether both of the valves are opened or only one of the valves is opened can be selected by turning ON or OFF the locking mechanism.

BRIEF DESCRIPTION OF THE DRAWINGS

The features, advantages thereof, and technical and industrial significance of the invention will be better understood by reading the following detailed description of example embodiments of the invention, when considered in connection with the accompanying drawings, in which.

DETAILED DESCRIPTION OF THE EXAMPLE EMBODIMENTS

Figure 1:
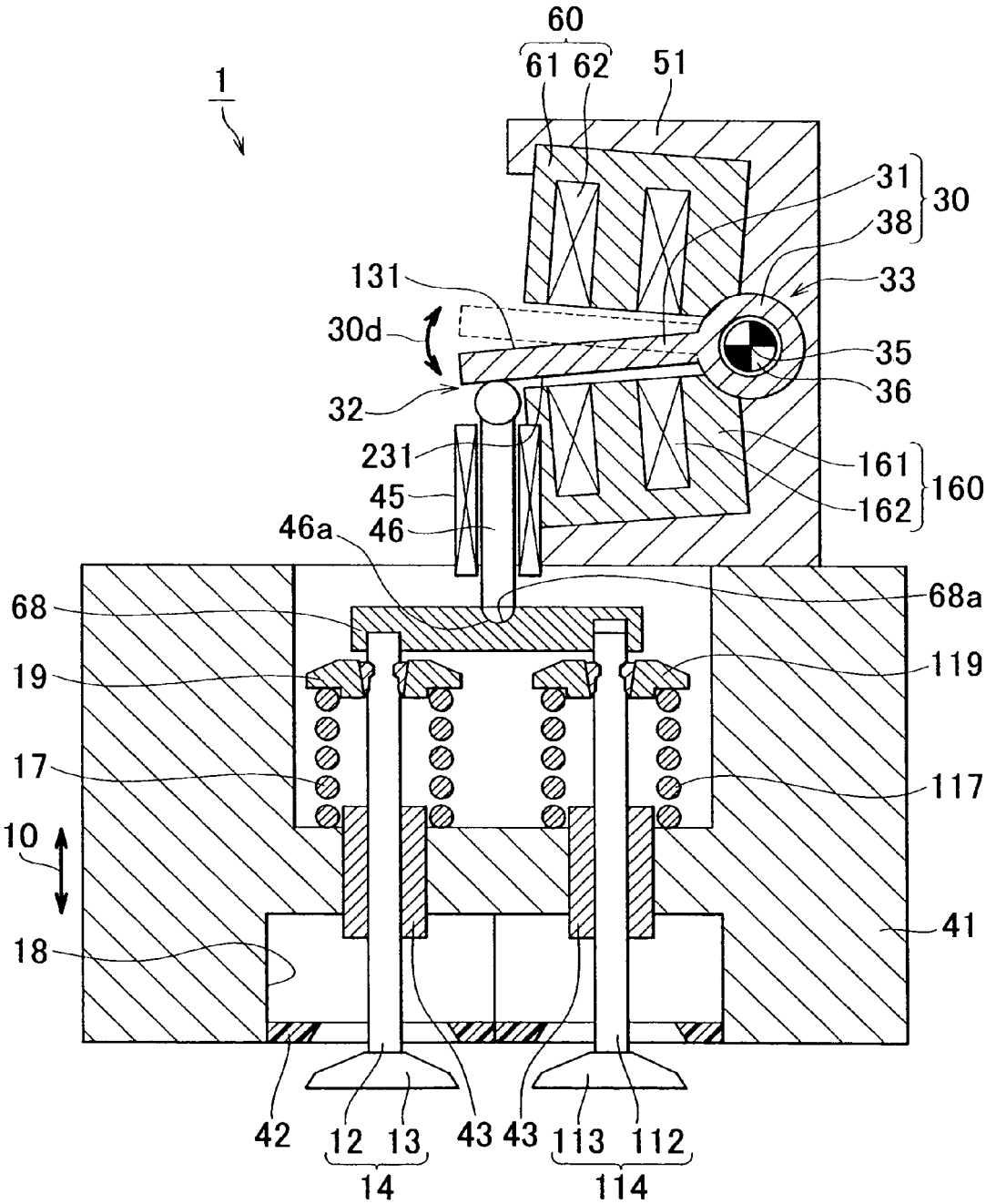
FIG. 1 illustrates the cross-sectional view of an electromagnetically driven valve according to a first embodiment of the invention.

Hereafter, example embodiments of the invention will be described with reference to accompanying drawings. In the embodiments, the same or corresponding portions will be denoted by the same reference numerals, and will be described only once.

First Embodiment

FIG. 1 illustrates the cross-sectional view of an electromagnetically driven valve according to a first embodiment of the invention. As shown in FIG. 1, an electromagnetically driven valve 1 includes a main body 51; an upper electromagnet 60 and a lower electromagnet 160 that are both fitted to the main body 51; a disc 30 that is arranged between the upper electromagnet 60 and the lower electromagnet 160; and a stem 46 that is driven by the disc 30.

The U-shaped main body 51 is a base member. Various components are fitted to the main body 51. The upper electromagnet 60 has a core 61 made of magnetic material, and a coil 62 wound around the core 61. Similarly, the lower electromagnet 160 has a core 161 made of magnetic material, and a coil 162 wound around the core 161. Application of an electric current to the coils 62, 162 generates magnetic force that drives the disc 30. The disc 30 is arranged between the upper electromagnet 60 and the lower electromagnet 160. The disc 30 is attracted to either the upper electromagnet 60 or the lower electromagnet 160 by the attraction force of the electromagnet. Thus, the disc 30 reciprocates between the upper electromagnet 60 and the lower electromagnet 160. The reciprocation of the disc 30 is transmitted to the stem 46.

The electromagnetically driven valve 1 is driven by electromagnetic force. The electromagnetically driven valve 1 is provided with multiple valve elements 14, 114 that include valve stems 12, 112 serving as valve shafts and that reciprocate in the direction in which the valve stems 12, 112 extend (in the direction of an arrow 10), respectively; the main body 51 serving as a support member that is arranged at a given distance from the valve elements 14, 114; the disc 30 serving as a pivoting member that has a driving end 32, which is operatively linked with the valve stems 12, 112, and a pivoting end 33 which is pivotably supported by the main body 51, and that pivots around a central axis which extends along the pivoting end 33; and a push plate 68 that drives the multiple valve elements 14, 114 when being pressed by the disc 30. The single push plate 68 drives two valve elements 14, 114 or more.

The electromagnetically driven valve 1 according to the first embodiment may be used as either an intake valve or an exhaust valve of an internal combustion engine such as a gasoline engine or a diesel engine. In the description of the first embodiment, the valve element is used as an intake valve arranged at an intake port 18. However, the invention may be applied to a valve element serving as an exhaust valve.

The electromagnetically driven valve 1 is a pivot-type electromagnetically driven valve. The disc 30 is used as a motion mechanism of the electromagnetically driven valve 1. The main body 51 is arranged on a cylinder head 41. The lower electromagnet 160 is arranged at the lower portion of the main body 51, and the upper electromagnet 60 is arranged at the upper portion of the main body 51. The lower electromagnet 160 has the core 161 made of iron and the coil 162 wound around the core 161. When an electric current is applied to the coil 162, a magnetic field is produced around the coil 162. Using the magnetic field, the lower electromagnet 160 attracts the disc 30.

The upper electromagnet 60 has the core 61 made of iron and the coil 62 wound around the core 61. When an electric current is applied to the coil 62, a magnetic field is produced around the coil 62. Using the magnetic field, the upper electromagnet 60 attracts the disc 30.

The coil 62 of the upper electromagnet 60 and the coil 162 of the lower electromagnet 160 may be connected to each other. Alternatively, the coil 62 of the upper electromagnet 60 and the coil 162 of the lower electromagnet 160 may be separated from each other. The number of turns of each of the coil 62 wound around the core 61 and the coil 162 wound around the core 161 is not limited to a particular number.

The disc 30 has an arm portion 31 and a bearing portion 38. The arm portion 31 extends from the driving end 32 to the pivoting end 33. The arm portion 31 is attracted alternately to the upper electromagnet 60 and the lower electromagnet 160, thereby pivoting (oscillating) in the direction of an arrow 30*d*. The bearing portion 38 is fitted to the end portion of the arm portion 31. The arm portion 31 pivots around the bearing portion 38. An upper surface 131 of the arm portion 31 can contact the upper electromagnet 60, and a lower surface 231 can contact the lower electromagnet 160. Also, the lower surface 231 contacts the stem 46.

The bearing portion 38 has a cylindrical shape. A torsion bar 36 is housed in the cylindrical bearing portion 38. A first end portion of the torsion bar 36 is splined to the main body 51, and a second end portion of the torsion bar 36 is fitted to the bearing portion 38. With this configuration, when the bearing portion 38 starts rotating, the torsion bar 36 applies a counter force against the rotation to the bearing portion 38. Thus, an urging force is always applied to the bearing portion 38 to urge the disc 30 to the neutral position. At the driving end 32 of the arm portion 31, the stem 46 is provided so as to contact the disc 30. The stem 46 is guided by a stem guide 45. The stem 46 and the disc 30 can pivot in the direction of the arrow 30*d*.

The main body 51 is fitted to the cylinder head 41. The intake port 18 is formed in the lower portion of the cylinder head 41. The intake port 18 is used as a passage through which intake air is introduced into a combustion chamber. An air-fuel mixture or air flows through the intake port 18. A valve seat 42 is provided between the intake port 18 and the combustion chamber, thereby improving sealability of the valve element 14.

The valve elements 14, 114 serving as intake valves are fitted to the cylinder head 41. The valve elements 14, 114 have the valve stems 12, 112 that extend in the longitudinal direction, and bell portions 13, 113 that are fitted to the end portions of the valve stems 12, 112, respectively. The valve stems 12, 112 are guided by respective stem guides 43. The valve stems 12, 112 are fitted to the push plate 68. The upper portions of the valve stems 12, 112 are fitted to spring retainers 19, 119, and the valve stems 12, 112 are driven together with the spring retainer 19, 119, respectively. A force is applied to the spring retainers 19, 119 by valve springs 17, 117, respectively. Accordingly, the spring retainers 19, 119 are moved upward by the valve springs 17, 117, respectively.

The push plate 68 is fitted to the valve stems 12 of the valve element 14 and the valve stem 112 of the valve element 114. The stem 46 contacts the push plate 68 at substantially the midpoint between the two valve stems 12, 112. The stem 46 is arranged between the push plate 68 and the disc 30. The stem 46 receives a force from the disc 30, thereby pressing the push plate 68 downward.

Next, the operation of the electromagnetically driven valve 1 according to the first embodiment will be described. To drive the electromagnetically driven valve 1, first, an electric current is applied to either the coil 62 of the upper electromagnet 60 or the coil 162 of the lower electromagnet 160. For example, in the first embodiment, an electric current is applied to the coil 62. Thus, a magnetic field is produced around the coil 62, and the arm portion 31 of the disc 30, which is made of magnetic material, is attracted to the upper electromagnet 60. When the arm portion 31 moves upward, the torsion bar 36 is twisted, and starts to move the arm portion 31 downward. However, because the attraction force of the upper electromagnet 60 is stronger than the torsion force of the torsion bar 36, the arm portion 31 moves further upward, and, finally, the upper surface 131 of the arm portion 31 contacts the upper electromagnet 60. As the arm portion 31 moves upward, the valve elements 14, 114, which are pressed upward by the valve springs 17, 117, move upward together with the arm portion 31 and the push plate 68. Thus, the valve elements 14, 114 are closed.

To open the valve element 14, the arm portion 31 needs to be moved downward. In this case, first, application of an electric current to the coil 62 is stopped, or the amount of electric current applied to the coil 62 is reduced. Thus, the electromagnetic force acting between the upper electromagnet 60 and the arm portion 31 is reduced. Because a torsion force is applied to the arm portion 31 by the torsion bar 36, the torsion force (elastic force) exceeds the electromagnetic force, and the arm portion 31 moves to the neutral position in FIG. 1. Next, an electric current is applied to the coil 162 of the lower electromagnet 160. Thus, a magnetic field is produced around the coil 162, and the arm portion 31 made of magnetic material is attracted to the lower electromagnet 160. At this time as well, because the stem 46 is pressed by the arm portion 31, the stem 46 moves downward. The attraction force of the coil 162 exceeds the torsion force of the torsion bar 36, and, therefore, the lower surface 231 of the disc 30 finally contacts the lower electromagnet 160. At this time, the push plate 68 and the valve elements 14, 114 also move downward and the valve elements 14, 114 are opened.

The arm portion 31 pivots in the direction of the arrow 30*a* by repeatedly performing the above-described upward movement and downward movement. As the arm portion 31 pivots, the bearing portion 38 connected to the arm portion 31 also pivots.

In the electromagnetically driven valve 1 thus configured according to the first embodiment, the two valve elements 14, 114 can be simultaneously driven by the single push plate 68. Thus, the number of coils can be reduced, and the actuator can be driven by the same amount of electric current as that used in an electromagnetically driven valve in which a push plate is not provided and the valve elements 14, 114 are driven using respective coils. Therefore, the power consumption can be significantly reduced.

In addition, the number of components can be reduced as compared to the case where the actuators are driven by the respective actuators. Therefore, the production cost can be reduced. In addition, because the number of circuits can be reduced, the production cost can be further reduced.

Second Embodiment

Figure 2:
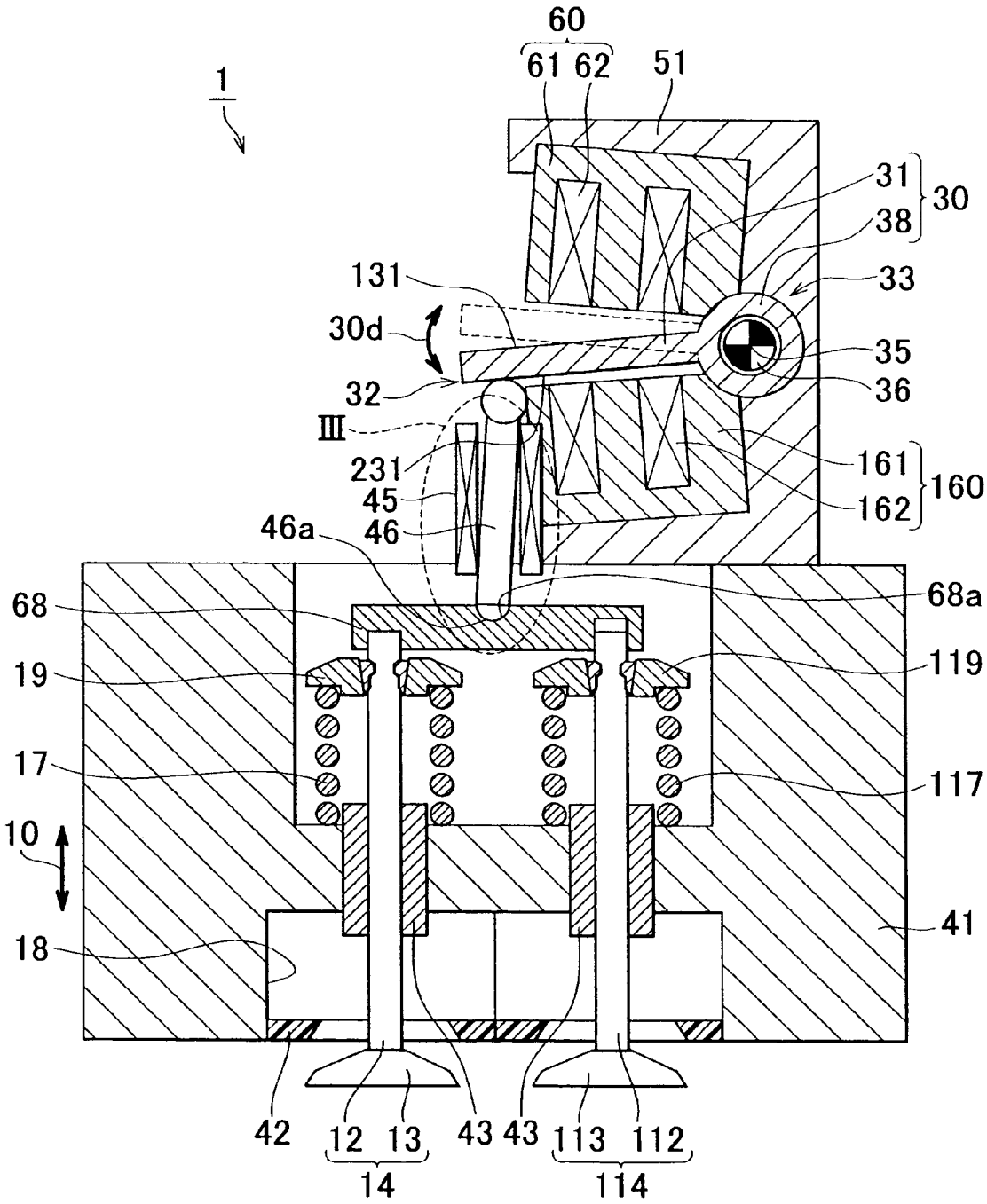
FIG. 2 illustrates the cross-sectional view of an electromagnetically driven valve according to a second embodiment of the invention.
Figure 3:
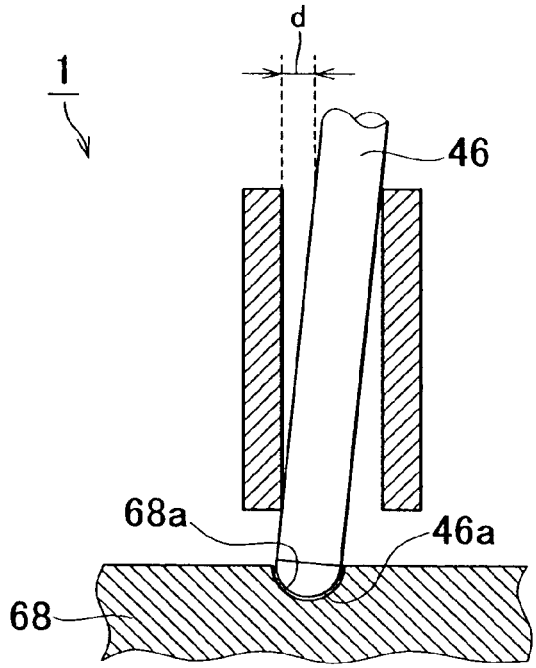
FIG. 3 illustrates the enlarged cross-sectional view of a portion circled by the dotted line III in FIG. 2.

FIG. 2 illustrates the cross-sectional view of an electromagnetically driven valve according to a second embodiment of the invention. FIG. 3 illustrates the enlarged cross-sectional view of a portion circled by the dotted line III in FIG. 2. As shown in FIGS. 2 and 3, the electromagnetically driven valve 1 according to the second embodiment differs from the electromagnetically driven valve 1 according to the first embodiment in that the push plate 68 and the stem 46 contact each other at a spherical surface. In FIG. 3, a concave portion 68*a* is formed in the push plate 68, and a convex portion 46*a* is formed in the stem 46. However, the configuration is not limited to this. For example, a convex portion may be formed in the push plate 68, and the concave portion may be formed in the stem 46.

A clearance is left between the stem 46 and the stem guide 45. In this case, the stem 46 may tilt with respect to the stem guide 45. However, because the stem 46 and the push plate 68 contact each other at the spherical surface, the pressure per unit area (hereinafter, referred to as the "unit pressure") can be reduced and, therefore, the durability of the portion, where the stem 46 and the push plate 68 contact each other, can be enhanced.

Figure 4:
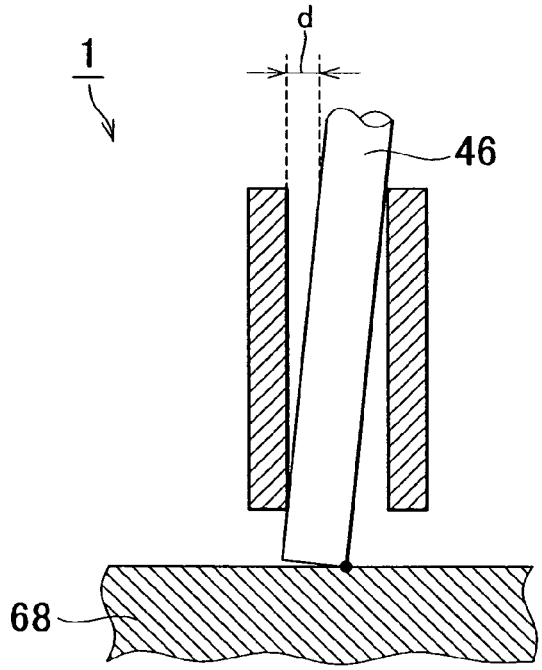
FIG. 4 illustrates the cross-sectional view of a part of another electromagnetically driven valve.

FIG. 4 illustrates the cross-sectional view of a part of another electromagnetically driven valve. As shown in FIG. 4, if the stem 46 contacts the push plate 68 at its tip, the unit pressure at the point, at which the tip contacts the push plate 68, may increase, which may reduce the durability.

With the electromagnetically driven valve 1 thus configured according to the second embodiment, the durability can be further increased.

Third Embodiment

Figure 5:
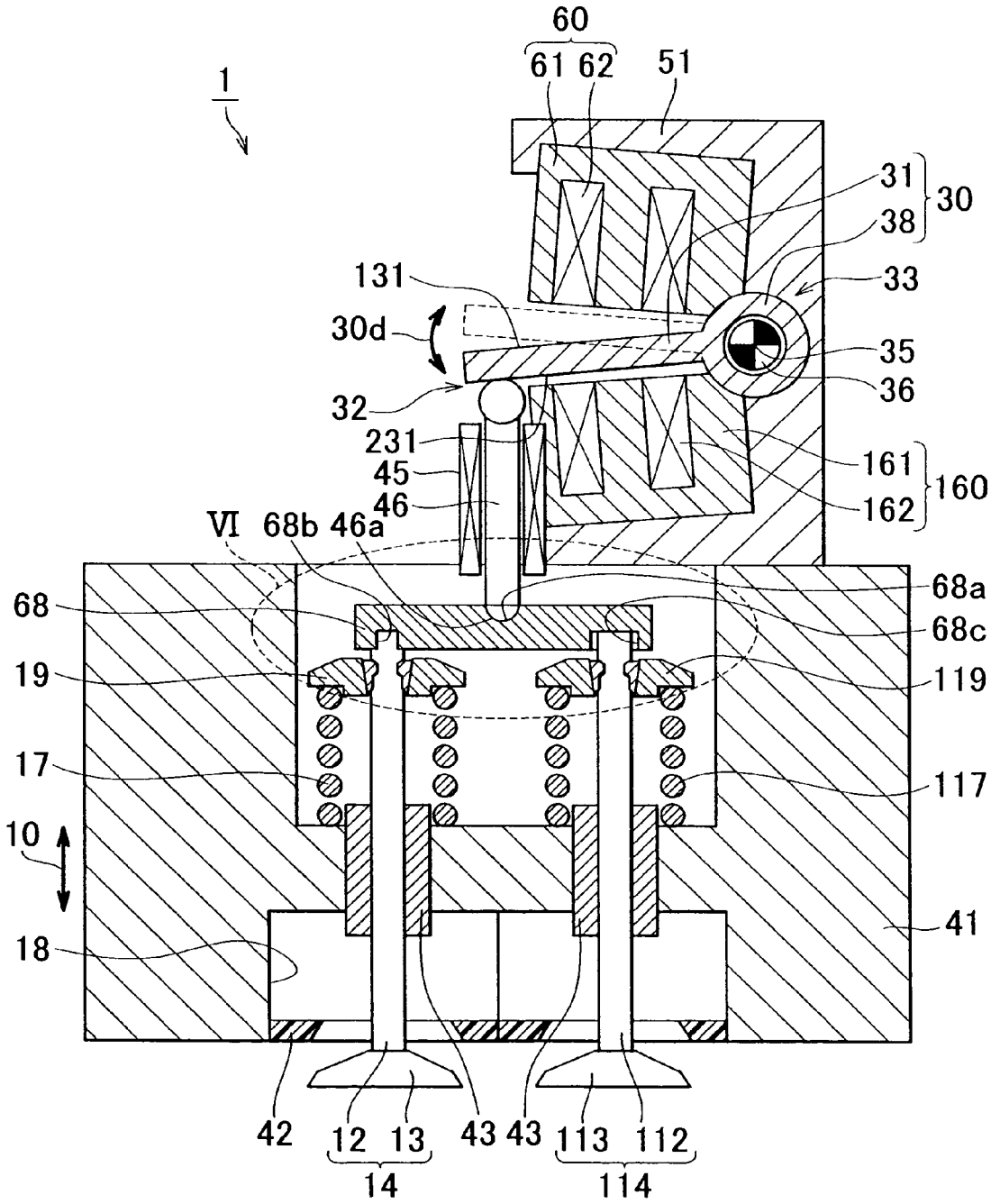
FIG. 5 illustrates the cross-sectional view of an electromagnetically driven valve according to a third embodiment of the invention.
Figure 6:
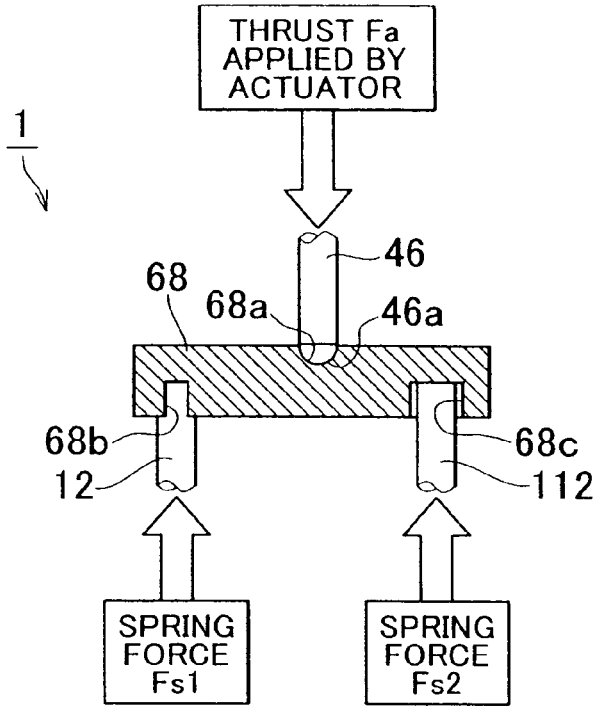
FIG. 6 illustrates the cross-sectional view of a portion circled by the dotted line VI in FIG. 5.

FIG. 5 illustrates the cross-sectional view of an electromagnetically driven valve according to a third embodiment of the invention. FIG. 6 illustrates the enlarged cross-sectional view of a portion circled by the dotted line VI in FIG. 5. As shown in FIGS. 5 and 6, the electromagnetically driven valve 1 according to the third embodiment differs from the electromagnetically driven valve 1 according to the first embodiment in that the valve stem 12 is fitted to the push plate 68 by press-fitting, and the valve stem 112 is fitted to the push plate 68 with a clearance left between the valve stem 112 and the push plate 68. Two concave portions 68*b*, 68*c* are formed in the push plate 68, the valve stem 12 is fitted in the concave portion 68*b* by press-fitting, and the valve stem 112 is fitted in the concave portion 68*c* with the clearance left between the valve stem 112 and the push plate 68. The method of fitting the valve stem 12 to the push plate 68 need not be press-fitting. The valve stem 12 may be fitted to the push plate 68 in a method other than press-fitting. The spring force (spring constant) differs between the valve springs 17, 117. More specifically, the spring force (spring constant) of the valve spring 17 is greater than that of the valve spring 117. Such a difference in the spring force may be intentionally made, or unintentionally made during production. A reference numeral Fs1 denotes the spring force of the valve spring 17, and a reference numeral Fs2 denotes the spring force of the valve spring 117. A thrust Fa is applied to the stem 46 by the actuators (the upper electromagnet 60 and the lower electromagnet 160). During the operation of opening the valve, the thrust Fa is greater than the sum of the spring force Fs1 and the spring force Fs2. The valve spring 17, which is provided for the valve stem 12, has the greater spring force than that of the valve spring 117, which is provided for the valve stem 112. Fitting the valve stem 12, which is provided with the valve spring 17 having the greater spring force, to the push plate 68 by press-fitting prevents the push plate 68 from tilting.

Figure 7:
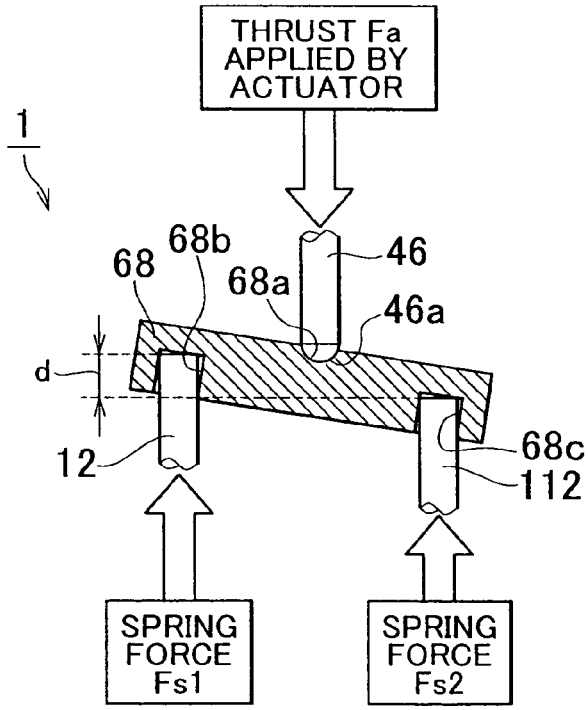
FIG. 7 illustrates the view of the configuration where each of two valve stems is fitted to a push plate with a clearance left between the valve stem and the push plate.

FIG. 7 illustrates the configuration where each of the two valve stems 12, 112 is fitted to the push plate 68 with a clearance left between the valve stem and the push plate 68. As shown in FIG. 7, when the valve stem 12 is fitted in the concave portion 68*b* with the clearance left therebetween and the valve stem 112 is fitted in the concave portion 68*c* with the clearance left therebetween, the portion of the push plate 68, which contacts the valve stem 12 with the valve spring 17 having the greater spring force, is pressed upward. As a result, the position of the top end of the valve stem in the vertical direction differs between the two valve stems 12, 112, thereby causing a difference in the valve lift amount between the two valve elements 14, 114. This affects the engine performance. In the configuration of the third embodiment shown in FIG. 6, such a problem is solved by fitting the valve stem, which is provided with the valve spring having a greater spring force, to the push plate 68 by press-fitting. Namely, the electromagnetically driven valve according to the third embodiment further includes the valve spring 17 serving as a first urging member and the valve spring 117 serving as a second urging member. The first and second urging members apply urging forces to the corresponding valve elements such that the valve elements move toward the disc 30. The urging force of the valve spring 17 serving as the first urging member is greater than the urging force of the valve spring 117 serving as the second urging member. The valve stem 12 of the valve element 14, to which a force is applied by the valve spring 17, is fixed to the push plate 68.

Fourth Embodiment

Figure 8:
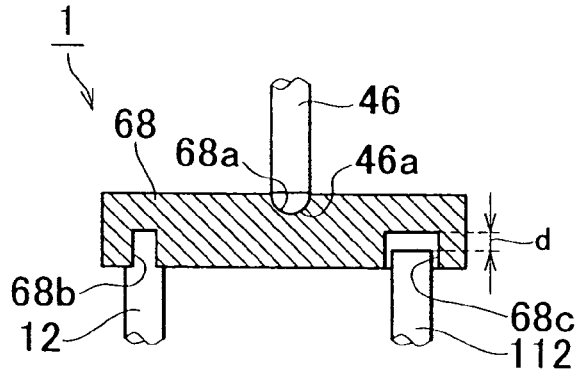
FIG. 8 illustrates the cross-sectional view of a push plate of an electromagnetically driven valve according to a fourth embodiment of the invention.

FIG. 8 illustrates the cross-sectional view of the push plate of an electromagnetically driven valve according to a fourth embodiment of the invention. As shown in FIG. 8, the electromagnetically driven valve 1 according to the fourth embodiment differs from the electromagnetically driven valve 1 according to the first embodiment in that the valve stem 112 is fitted in the concave portion 68*c* with a clearance "d" left therebetween in the axial direction, namely, with the clearance "d" left between the upper end surface of the valve stem 112 and the upper inner surface of the concave portion 68*c*. The valve stem 12 is fitted in the concave portion 68*b* by press-fitting.

Figure 9:
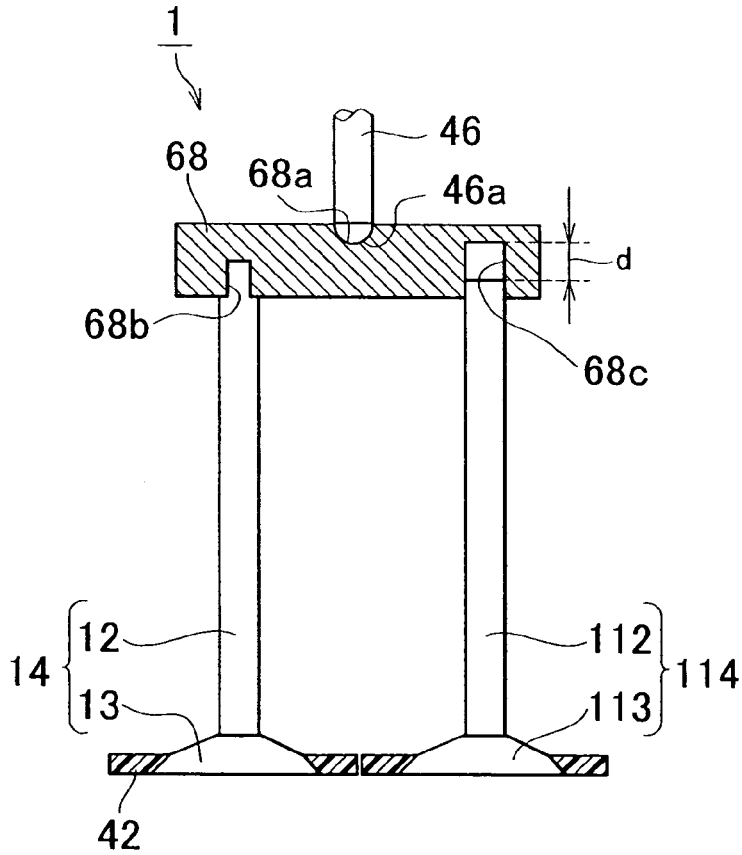
FIG. 9 illustrates the cross-sectional view for describing the operation of the electromagnetically driven valve in FIG. 8.
Figure 10:
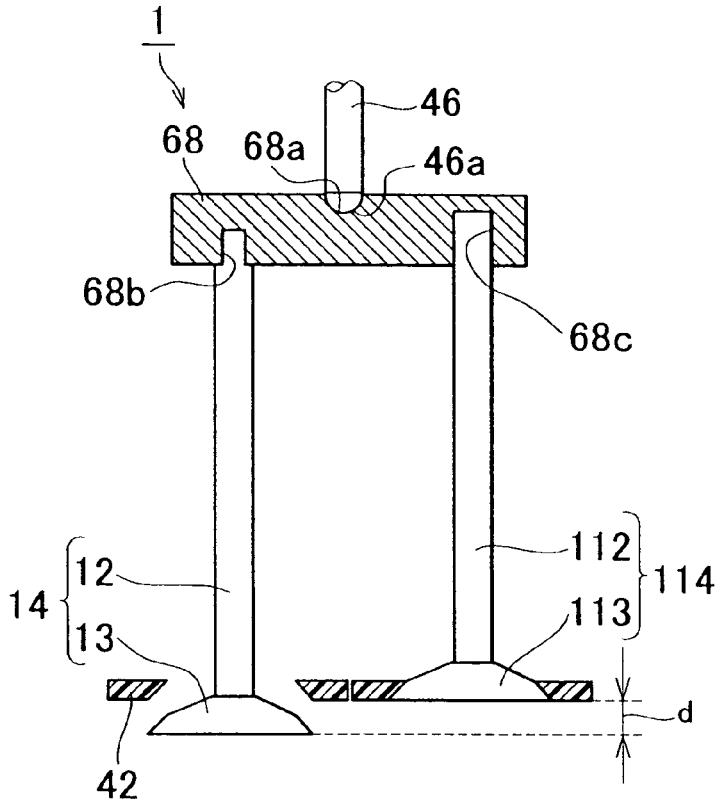
FIG. 10 illustrates the cross-sectional view for describing the operation of the electromagnetically driven valve in FIG. 8.
Figure 11:
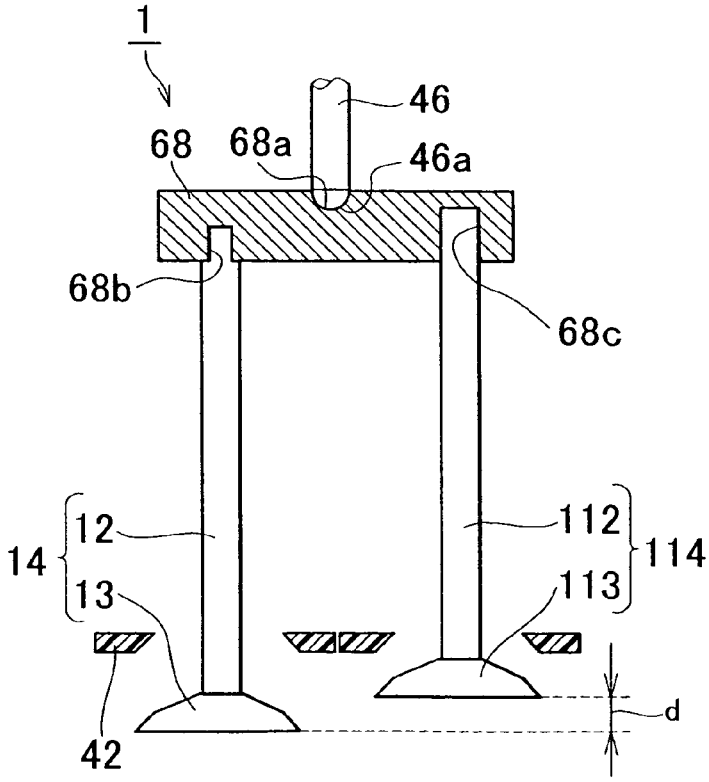
FIG. 11 illustrates the cross-sectional view for describing the operation of the electromagnetically driven valve in FIG. 8.

FIGS. 9 to 11 illustrate the cross-sectional views for describing the operation of the electromagnetically driven valve in FIG. 8. As shown in FIG. 9, when the valve is closed, the two valve elements 14, 114 are both closed. At this time, the clearance "d" is left between the push plate 68 and the valve stem 112.

As shown in FIG. 10, as the stem 46 moves the push plate 68 downward, the valve stem 12 also moves downward because it is fitted to the push plate 68 by press-fitting. In contrast, even if the push plate 68 moves by the amount corresponding to the clearance "d", the valve element 114 does not move, because the valve stem 112 is fitted in the concave portion 68*c* with the clearance "d" left between the valve stem 112 and the push plate 68. As a result, as shown in FIG. 10, only the valve element 14 opens, and the valve element 14 moves downward by the amount corresponding to the clearance As shown in FIG. 11, when the push plate 68 further moves downward, the valve element 114 also moves downward. At this time, the difference in the valve opening amount between the valve element 14 and the valve element 114 is "d", and, therefore, the difference in the valve lift amount between the valve element 14 and the valve element 114 corresponds to the clearance "d".

In the electromagnetically driven valve 1 thus configured according to the fourth embodiment, the valve lift amount differs between the two valve elements 14, 114, and the difference corresponds to the clearance. Because a swirling airflow can be formed on the intake side, the fuel economy is enhanced.

In the fourth embodiment, no member is arranged at the clearance "d". However, an elastic member may be arranged at the clearance "d".

The valve element 114, to which a force is applied by the valve spring 117 serving as the second urging member, is supported by the push plate 68 such that the valve element 114 can move with respect to the push plate 68 in the direction in which the valve stem 112 extends. Therefore, the valve lift amount differs between the two valve elements 14, 114.

Fifth Embodiment

Figure 12:
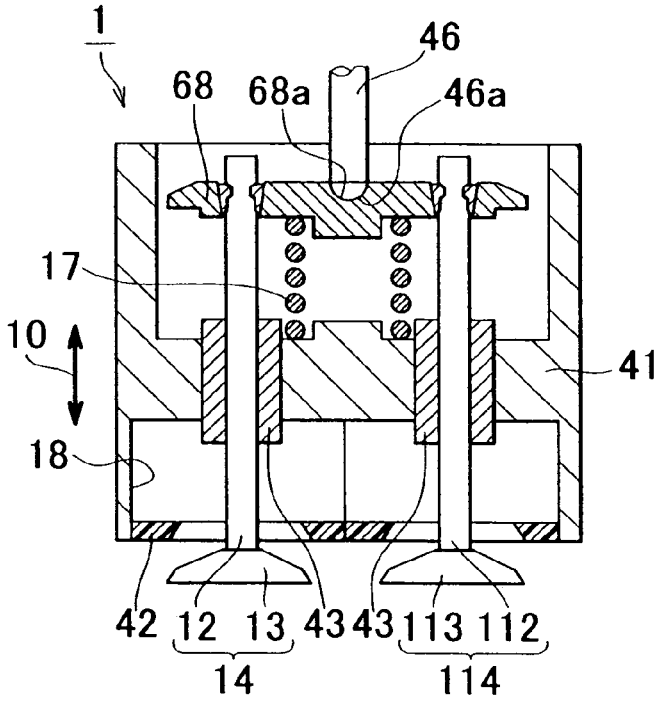
FIG. 12 illustrates the cross-sectional view of a part of an electromagnetically driven valve according to a fifth embodiment of the invention.
Figure 13:
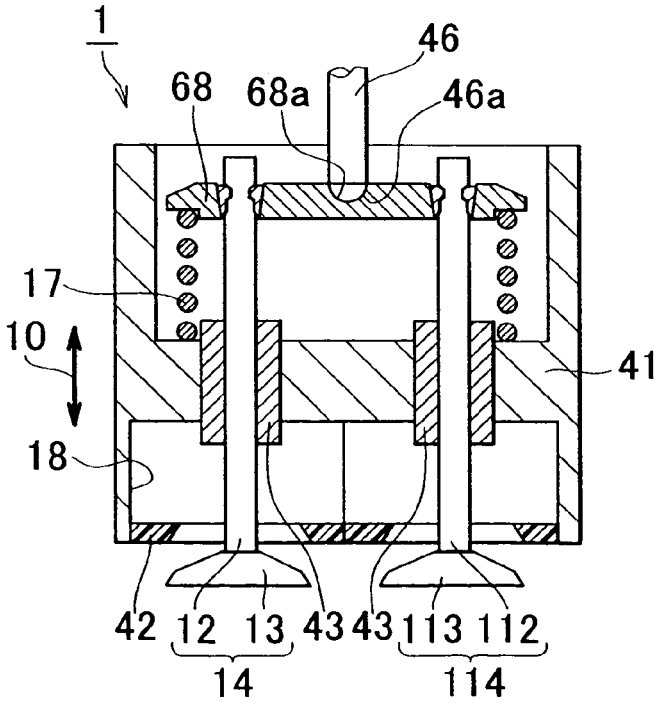
FIG. 13 illustrates the cross-sectional view of a part of the electromagnetically driven valve according to the fifth embodiment of the invention.

FIGS. 12 and 13 illustrate the cross-sectional view of a part of an electromagnetically driven valve according to a fifth embodiment of the invention. As shown in FIGS. 12 and 13, the electromagnetically driven valve 1 according to the fifth embodiment differs from the electromagnetically driven valve 1 according to the first embodiment in that the valve spring 17 presses the push plate 68. Namely, in the first embodiment, the valve elements 14, 114 are pressed by the valve springs 17, 117, respectively. In contrast, in the fifth embodiment, the spring retainers are not provided, and the valve spring 17 directly presses the push plate 68. In the fifth embodiment, the push plate 68 also serves as a retainer. The stem 46 and the valve spring 17 are arranged coaxially with each other.

In the electromagnetically driven valve 1 thus configured according to the fifth embodiment, the valve spring 17 is provided to the push plate 68, not to the valve. Accordingly, both of the valve elements 14, 114 can be moved by an intended valve lift amount. In addition, the production cost can be reduced by reducing the number of components. Because the push plate 68 is also used as the retainer, variation in the spring force between the springs need not be taken into account, and both of the valve elements 14, 114 can be moved by an intended valve lift amount. In addition, the production cost can be reduced by reducing the number of components. Namely, the number of the valve spring 17 serving as the urging member is less than the number of the multiple valve elements 14, 114, and the valve spring 17 applies a force to the push plate 68 such that the push plate 68 moves toward the disc 30.

Sixth Embodiment

Figure 14:
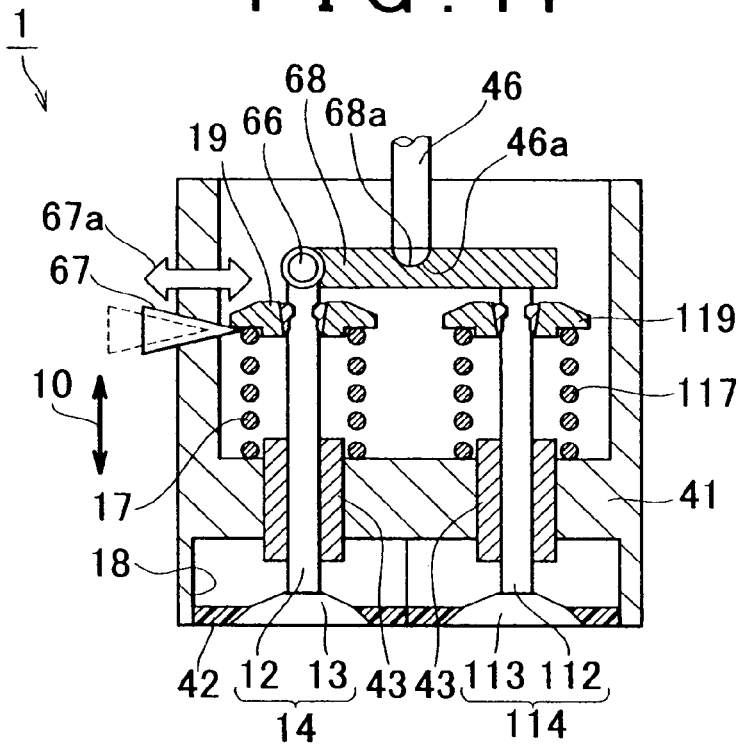
FIG. 14 illustrates the cross-sectional view of a part of an electromagnetically driven valve according to a sixth embodiment of the invention.

FIG. 14 illustrates the cross-sectional view of a part of an electromagnetically driven valve according to a sixth embodiment of the invention. As shown in FIG. 14, the electromagnetically driven valve 1 according to the sixth embodiment differs from the electromagnetically driven valve 1 according to the first embodiment in that a locking mechanism 67 that is driven by air pressure or hydraulic pressure is provided. The locking mechanism 67 can move in the direction of an arrow 67*a*, and can prevents the operation of the spring retainer 19. FIG. 14 shows the state where the valves 14, 114 are closed.

Figure 15:
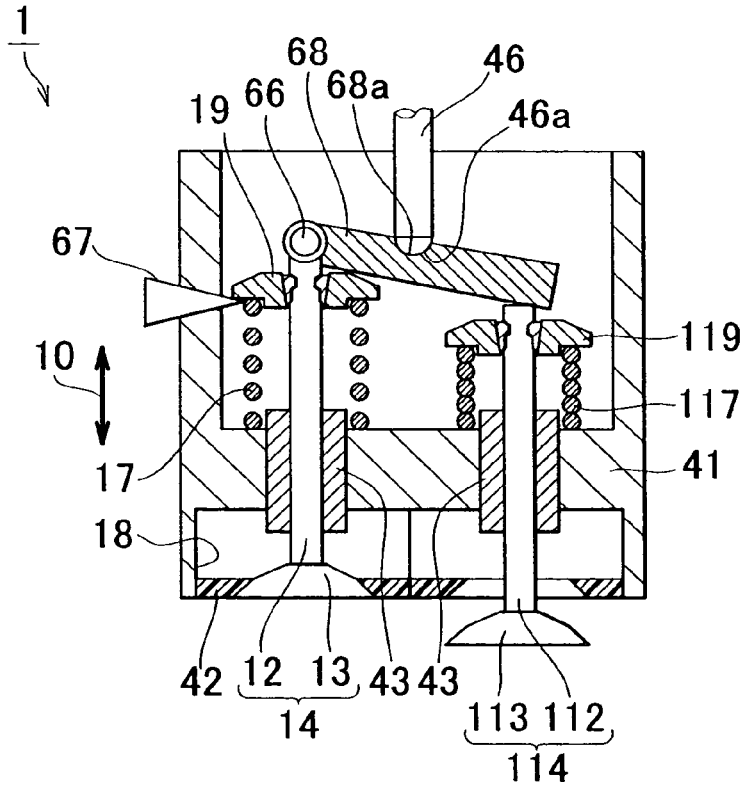
FIG. 15 illustrates the cross-sectional view for describing the operation of the electromagnetically driven valve in FIG. 14.
Figure 16:
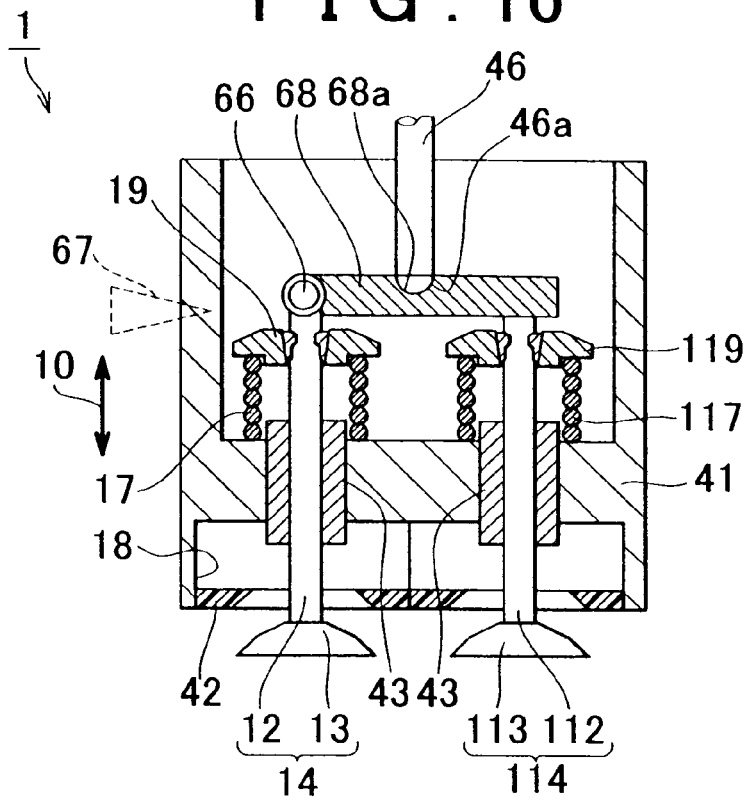
FIG. 16 illustrates the cross-sectional view for describing the operation of the electromagnetically driven valve in FIG. 14.

FIG. 15 illustrates the cross-sectional view for describing the operation of the electromagnetically driven valve in FIG. 14. FIG. 15 shows the electromagnetically driven valve where the spring retainer 19 is locked. FIG. 16 shows the electromagnetically driven valve where the spring retainer 19 is unlocked. As shown in FIG. 15, the spring retainer 19 is locked by the locking mechanism 67. A pivoting joint mechanism 66 is arranged between the valve stem 12 and the push plate 68. The push plate 68 can pivot around the pivoting joint mechanism 66 with respect to the valve stem 12. As shown in FIG. 15, when the spring retainer 19 is locked by the locking mechanism 67, the spring retainer 19 does not move downward even if the stem 46 is pressed downward. As a result, the valve element 14 does not move downward. In contrast, the valve element 114 moves downward. Therefore, only the valve element 114 opens.

As shown in FIG. 16, when the spring retainer 19 is not locked by the locking mechanism 67, if the stem 46 is pressed downward, both of the valve elements 14, 114 are pressed downward by the push plate 68. Thus, the two valves 14, 114 both open. In the sixth embodiment, the pivoting joint mechanism 66 is provided at one end of the push plate 68. By locking one of the valves, the operation of this valve can be stopped. Accordingly, only one actuator is required to stop the operation of-one of the valves. In the sixth embodiment, there are provided the pivoting joint mechanism 66 that connects the valve stem 12 to the push plate 68 such that the push plate 68 can pivot with respect to the valve stem 12; and the locking mechanism 67 serving as a stopping portion that stops a valve opening operation of the valve stem 12 that is connected to the pivoting joint mechanism 66.

Seventh Embodiment

Figure 17:
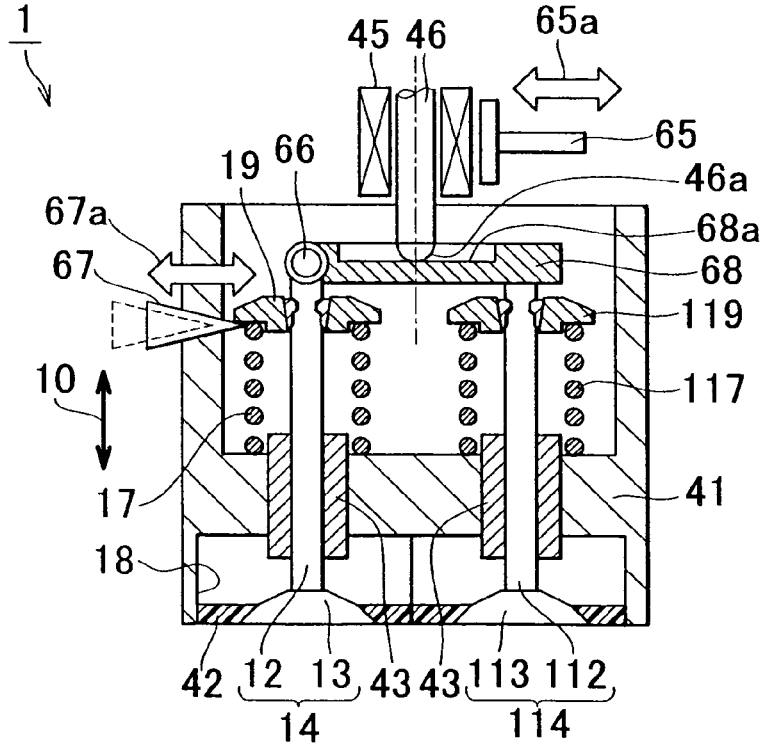
FIG. 17 illustrates the cross-sectional view of a part of an electromagnetically driven valve according to a seventh embodiment of the invention.

FIG. 17 illustrates the cross-sectional view of a part of an electromagnetically driven valve according to a seventh embodiment of the invention. As shown in FIG. 17, the electromagnetically driven valve 1 according to the seventh embodiment differs from the electromagnetically driven valve 1 according to the sixth embodiment in that a moving mechanism 65 that moves the stem 46 is provided. The moving mechanism 65 changes the position of the stem 46 using hydraulic pressure or air pressure. The moving mechanism 65 can move the stem 46 in the direction of an arrow 65*a*. By moving the stem 46 in the lateral direction, the position, at which a force is transmitted from the stem 46 to the push plate 68, is moved in the lateral direction. Thus, the valve lift amount can be changed. Namely, in the seventh embodiment, the configuration of the sixth embodiment is employed, and the position, at which a force from the actuator is transmitted to the push plate 68, is changed. Thus, even if the operation of one of the valves is stopped, the valve lift amount of the other valve can be changed by changing the position at which a force from the actuator is transmitted to the push plate 68.

Figure 18:
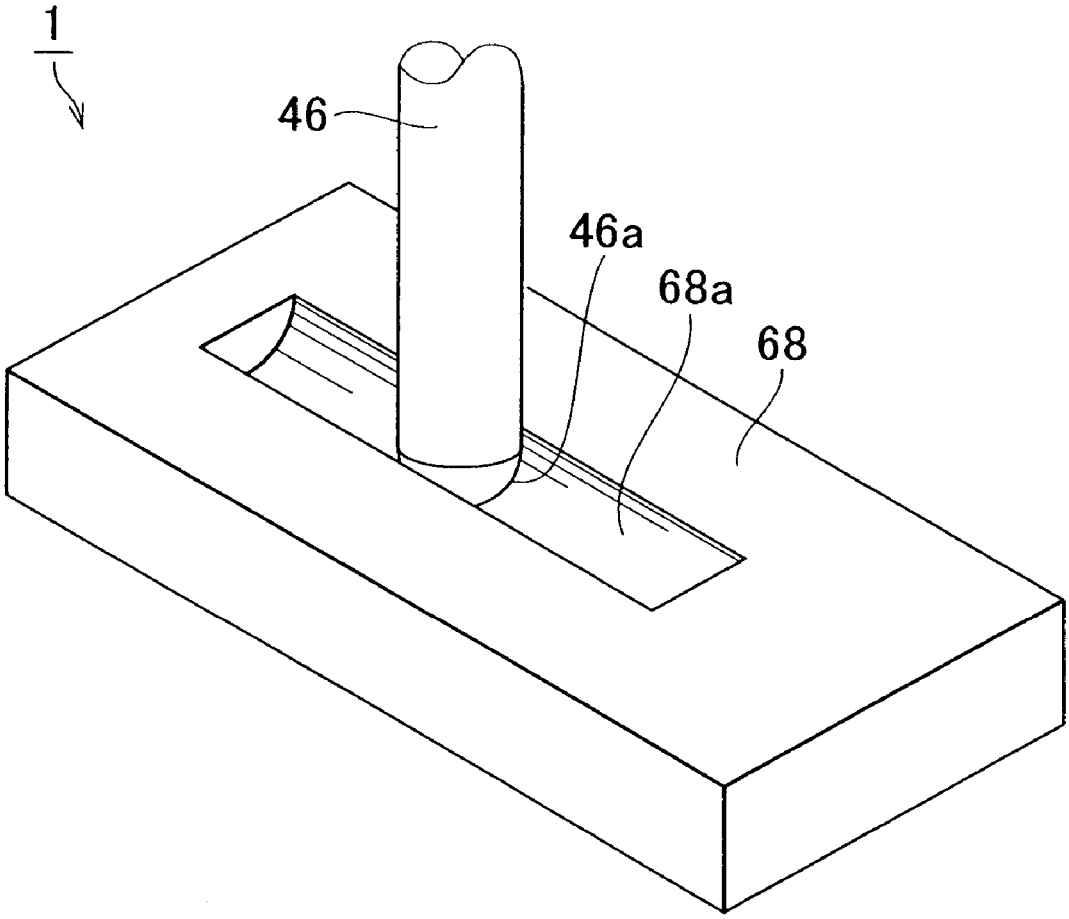
FIG. 18 illustrates the perspective view of a push plate and a stem in FIG. 17.

FIG. 18 illustrates the perspective view of the push plate and the stem in FIG. 17. As shown in FIG. 18, the concave portion 68*a* is linearly formed in the push plate 68. The concave portion 68*a* defines a space having a semi-cylindrical shape. The convex portion 46*a* of the tip portion of the stem 46 contacts the surface of the concave portion 68*a*. The stem 46 can move in the direction in which the concave portion 68*a* extends.

Figure 19:
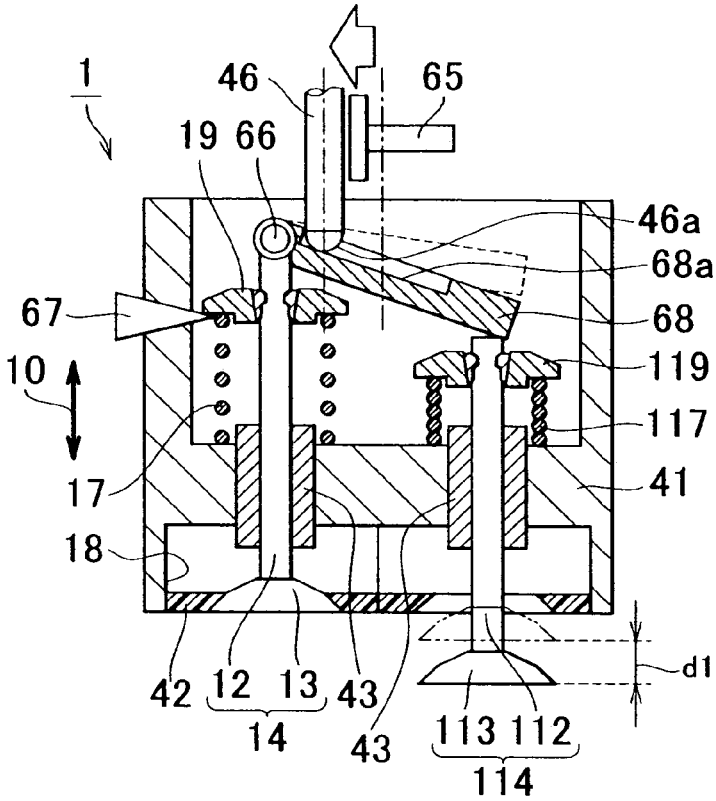
FIG. 19 illustrates the cross-sectional view of a part of the electromagnetically driven valve, for describing the operation of a moving mechanism.
Figure 20:
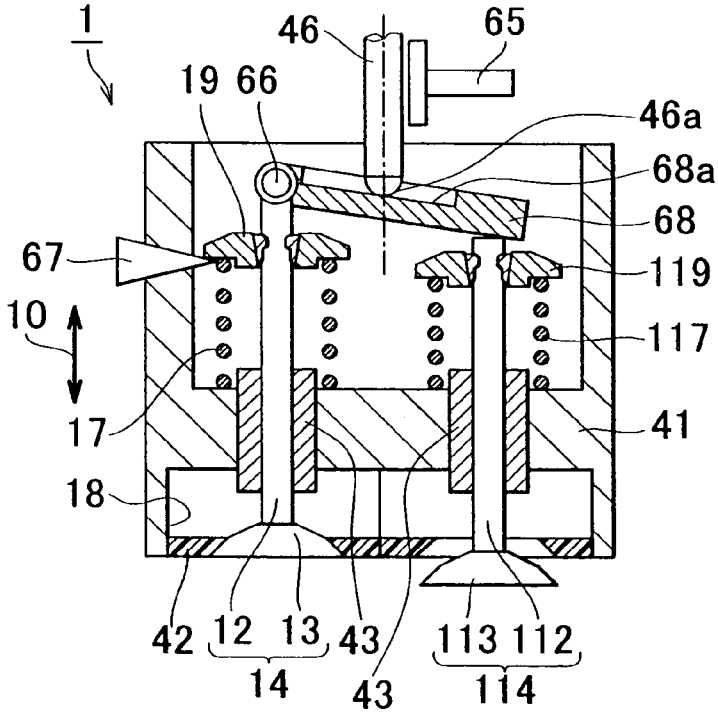
FIG. 20 illustrates the cross-sectional view of a part of the electromagnetically driven valve, for describing the operation of the moving mechanism.
Figure 21:
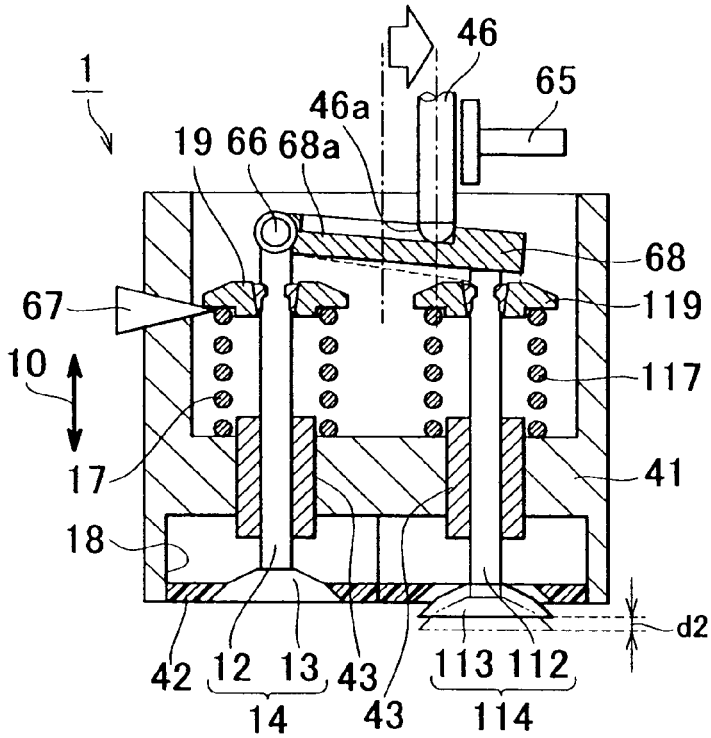
FIG. 21 illustrates the cross-sectional view of a part of the electromagnetically driven valve, for describing the operation of the moving mechanism.

FIGS. 19 to 21 illustrate the cross-sectional views of a part of the electromagnetically driven valve, for describing the operation of the moving mechanism. As shown in FIG. 19, when the stem 46 is moved to the extreme left using the moving mechanism 65, the valve element 114 moves by a great amount due to reciprocation of the stem 46. More specifically, the deviation of the valve lift amount of the valve element 114 from the reference valve lift amount is "d1". As shown in FIG. 20, when the stem 46 is positioned at the reference position (middle position), the valve element 114 is moved by a predetermined amount in accordance with the operation of the stem 46.

As shown in FIG. 21, the stem 46 is moved rightward. The valve element 114 moves due to reciprocation of the stem 46. The deviation of the valve lift amount of the valve element 114 from the reference valve lift amount is "d2". Namely, in the seventh embodiment, there is further provided the moving mechanism 65 that can change the position, at which a force is transmitted from the stem 46 to the push plate 68, in the direction in which the multiple valve elements 14, 114 are arranged.

Eighth Embodiment

Figure 22:
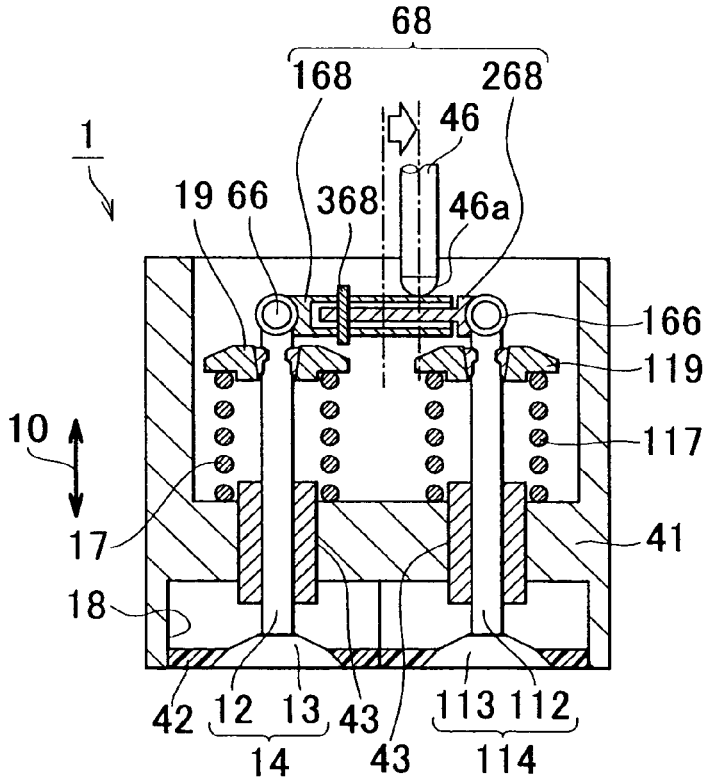
FIG. 22 illustrates the cross-sectional view of an electromagnetically driven valve according to an eighth embodiment of the invention.

FIG. 22 illustrates the cross-sectional view of a part of an electromagnetically driven valve according to an eighth embodiment of the invention. As shown in FIG. 22, in the electromagnetically driven valve according to the eighth embodiment, the push plate 68 includes a first member 168 and a second member 268. The first member and the second member 268 can slide with respect to each other in the longitudinal direction. In addition, a lock pin 368 for fixing the position of the first member 168 with respect to the second member 268 is provided. The first member 168 is connected to the valve stem 12 by the pivoting joint mechanism 66, and the second member 268 is connected to the valve stem 112 by a pivoting joint mechanism 166. The push plate 68 includes the first member 168 serving as an inserted member and the second member 268 serving as an inserting member. The first member 168 and the second member 268 can slide with each other. The first member 168 is connected to the valve element 14 via the pivoting joint mechanism 66, and the second member 268 is connected to the valve element 114 via the pivoting joint mechanism 166. There is further provided the lock pin 368 that prevents the first member 168 and the second member 268 from sliding with respect to each other. The position, at which the force is transmitted from the stem 46 to the push plate 68, deviates from the center of the push plate 68 in the longitudinal direction.

Figure 23:
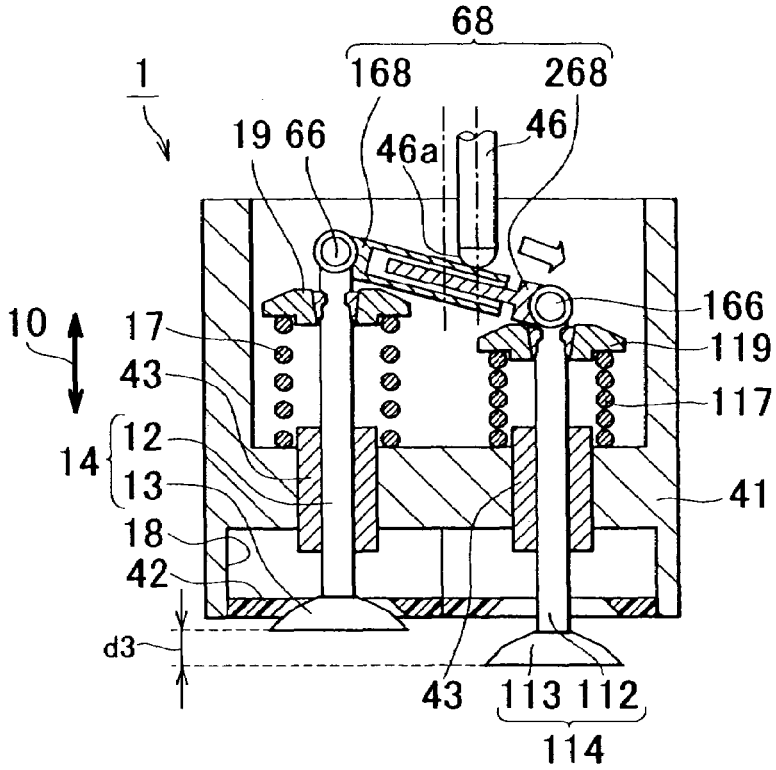
FIG. 23 illustrates the cross-sectional view for describing the operation of the electromagnetically driven valve in FIG. 22.
Figure 24:
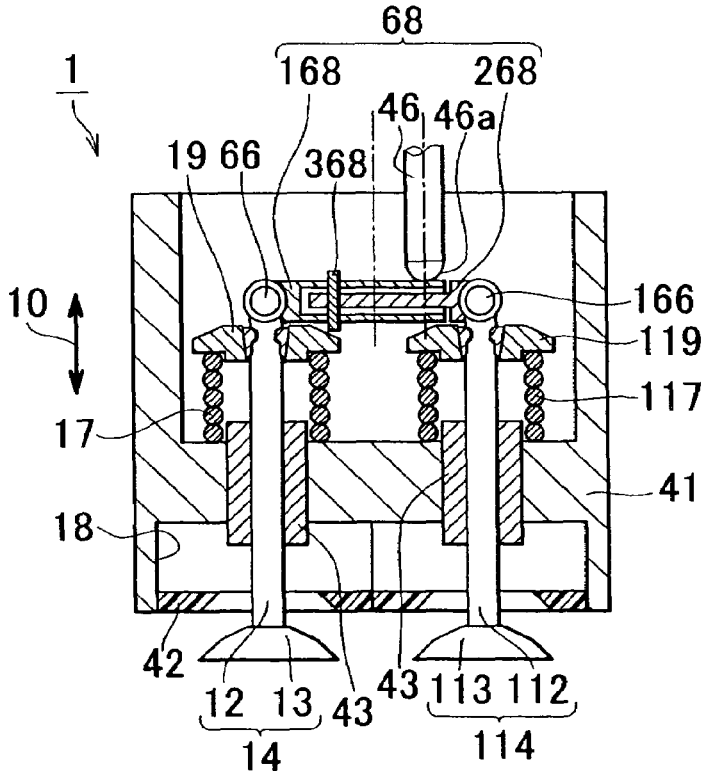
FIG. 24 illustrates the cross-sectional view for describing the operation of the electromagnetically driven valve in FIG. 22.

FIGS. 23 and 24 are the cross-sectional views for describing the operation of the electromagnetically driven valve according to the eighth embodiment. As shown in FIG. 23, if the push plate 68 is pressed downward by the stem 46 while the lock pin is not used, a great amount of force is applied to the valve element 114 that is closer to the stem 46, and the valve element 114 is moved by a great amount. As a result, the difference in the valve lift amount between the two valve elements 14, 114 is "d3". As shown in FIG. 24, when the stem 46 is pressed downward while the lock pin is used, the force is applied substantially evenly to the two valve elements 14, 114. Accordingly, the two valve elements 14, 114 are moved by substantially the same amount, resulting in substantially no difference in the valve lift amount between the two valve elements 14, 114. In the eighth embodiment, the ends of the push plate 68 are connected to the valve stems 12, 112 of the valve elements 14, 114 via the pivoting joint mechanism 66, 166, respectively. The lock pin 368 serving as a slide and locking mechanism is provided to the push plate 68. When the lock pin 368 is not used, it possible to create a difference in the valve lift amount between the two valve elements 14, 114. On the other hand, when the lock pin 368 is used, it is possible to eliminate such difference in the valve lift amount. Also, the operation of one of the valves can be stopped by adjusting the lift amount by the actuator.

Ninth Embodiment

Figure 25:
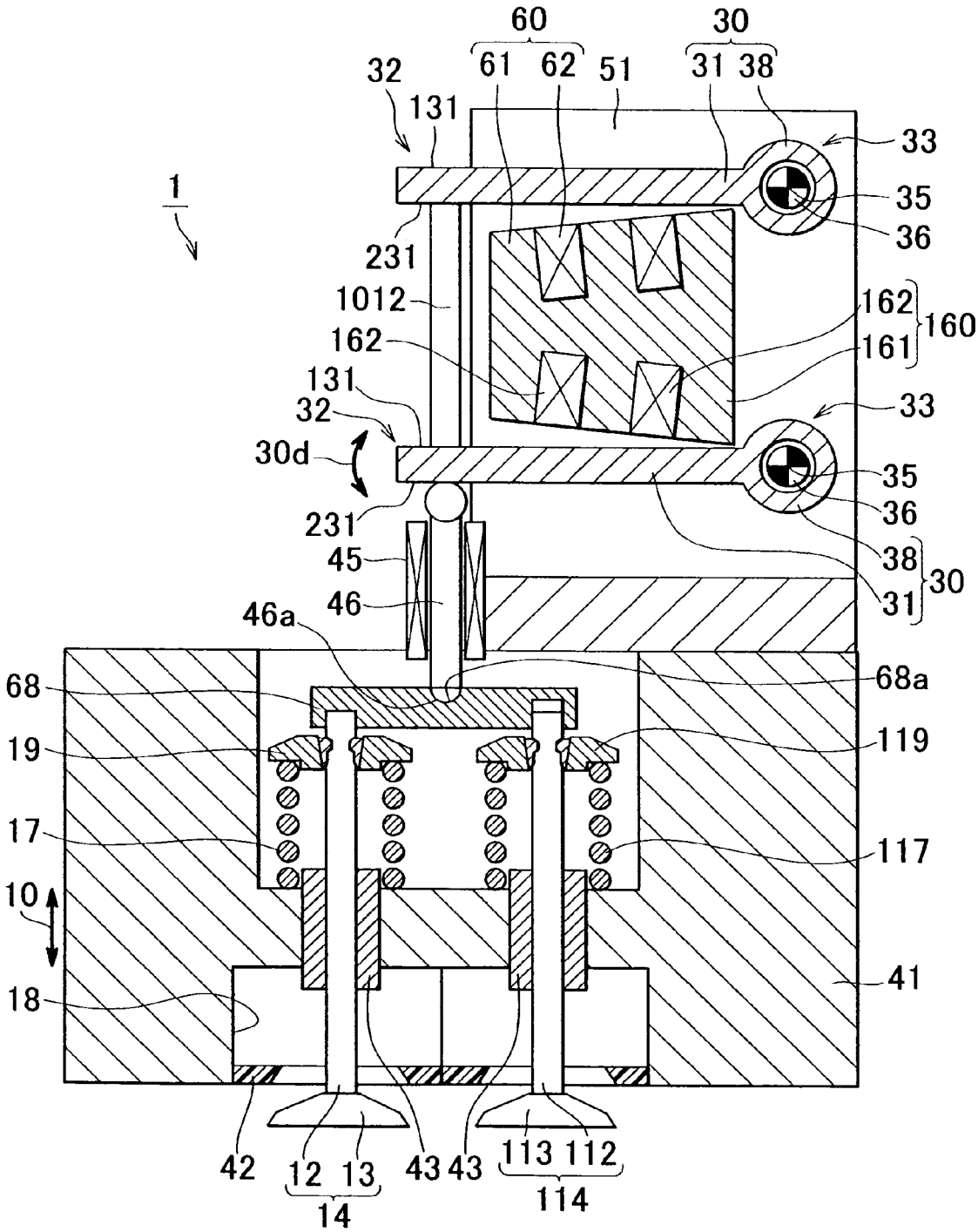
FIG. 25 illustrates the cross-sectional view of an electromagnetically driven valve according to a ninth embodiment of the invention.

FIG. 25 illustrates the cross-sectional view of an electromagnetically driven valve according to a ninth embodiment of the invention. As shown in FIG. 25, the electromagnetically driven valve 1 according to the ninth embodiment differs from the electromagnetically driven valve according to the first embodiment in that two discs 30, that are, an upper disc 30 and a lower disc 30, are provided. The upper disc 30 and the lower disc 30 are connected to each other by a stem 1012.

As in the embodiments described above, each disc 30 is pivotably fixed to the main body 51 via the bearing portion 38. The upper electromagnet 60 and the lower electromagnet 160 are provided between the two discs 30. The arm portion 31 of the upper disc 30 is attracted to the upper electromagnet 60 by the attraction force that is generated by applying an electric current to the coil 62 of the upper electromagnet 60. Also, the arm portion 31 of the lower disc 30 is attracted to the lower electromagnet 160 by the attraction force that is generated by applying an electric current to the coil 162 of the lower electromagnet 160. When the arm portion 31 of the lower disc 30 moves upward, the torsion bar 36 is twisted and starts moving the arm portion 31 downward. However, because the attraction force of the lower electromagnet 160 is stronger than the torsion force of the torsion bar 36, the lower arm portion 31 moves further upward, and, finally, the upper surface 131 contacts the lower electromagnet 160. As the arm portion 31 moves upward, the valve elements 14, 114, which are pressed upward by the valve springs 17, 117, move upward along with the arm portion 31 and the push plate 68. Thus, the valve elements 14, 114 are closed.

To open the valve element 14, the arm portion 31 needs to be moved downward. In this case, first, application of an electric current to the coil 162 is stopped, or the amount of electric current applied to the coil 162 is reduced. Thus, the electromagnetic force acting between the lower electromagnet 160 and the lower arm portion 31 is reduced. Because a torsion force is applied to the arm portion 31 by the torsion bar 36, the torsion force (elastic force) exceeds the electromagnetic force, and the arm portion 31 moves to the neutral position in FIG. 1. Next, when an electric current is applied to the coil 62 of the upper electromagnet 60, the arm portion 31 of the upper disc 30 made of magnetic material is attracted to the upper electromagnet 60. At this time, the arm portion 31 of the upper disc 30 moves the arm portion 31 of the lower disc 30 downward via the stem 1012, presses the push plate 68, and the valve elements 14, 114 move downward and open.

The arm portion 31 pivots in the direction of the arrow 30*a* by repeatedly performing the above-described upward movement and downward movement. As the arm portion 31 pivots, the bearing portion 38 connected to the arm portion 31 also pivots.

The electromagnetically driven valve 1 thus configured according to the ninth embodiment produces the same effects as those of the electromagnetically driven valve 1 according to the first embodiment.

While the embodiments of the inventions has been described, various modifications may be made to the embodiments. In the first to eighth embodiments, one disc 30 is used. However, as in the ninth embodiment, two discs 30 may be used.

The coil 62 of the upper electromagnet 60 and the coil 162 of the lower electromagnet 160 may be formed of a single coil. However, the coil 62 and the coil 162 may be formed of separate coils, and may be individually controlled.

The embodiments of the invention that have been disclosed in the specification are to be considered in all respects as illustrative and not restrictive. The technical scope of the invention is defined by claims, and all changes which come within the meaning and range of equivalency of the claims are therefore intended to be embraced therein.

For example, the invention may also be used in a field of an electromagnetically driven valve for an internal combustion engine mounted in a vehicle.

What is claimed is:

1. An electromagnetically driven valve, comprising:

multiple valve elements that have respective valve shafts and reciprocate in a direction in which the valve shafts extend, the multiple valve elements comprise at least a first valve element and a second valve element;

a pivoting member that extends from a driving end, which is operatively linked with the valve shafts, to a pivoting end, and that pivots around a central axis which extends along the pivoting end;

a support member that supports the valve elements;

a single push plate that is pressed by the pivoting member, thereby moving the multiple valve elements; and a valve lift amount differs between the first and second valve elements when the pivoting member pivots downward.

2. The electromagnetically driven valve according to claim 1, further comprising:

a stem that is arranged between the pivoting member and the push plate, wherein the stem and the push plate contact each other at a spherical surface.

3. The electromagnetically driven valve according to claim 1, further comprising:

a pivoting joint mechanism that pivotably connects the valve shaft of at least one of the multiple valve elements to the push plate; and a stopping portion that stops a valve opening operation of the valve shaft that is connected to the pivoting joint mechanism.

4. The electromagnetically driven valve according to claim 3, further comprising:

a moving portion that can change a position, at which a force is transmitted from the pivoting member to the push plate, in a direction in which the multiple valve elements are arranged.

5. The electromagnetically driven valve according to claim 1, wherein the push plate includes an inserted member and an inserting member that can slide with respect to each other in a longitudinal direction, the inserted member is connected to one of the valve elements via a pivoting joint mechanism, and the inserting member is connected to the other valve element via another pivoting joint mechanism, the push plate is provided with a locking mechanism that prevents the inserted member and the inserting member from sliding with each other, and a position, at which a force is transmitted from the pivoting member to the push plate, deviates from a center of the push plate in the longitudinal direction.

6. An electromagnetically driven valve, comprising:

multiple valve elements that have respective valve shafts and reciprocate in a direction in which the valve shafts extend;

a pivoting member that extends from a driving end, which is operatively linked with the valve shafts, to a pivoting end, and that pivots around a central axis which extends along the pivoting end;

a support member that supports the valve elements;

a single push plate that is pressed by the pivoting member, thereby moving the multiple valve elements;

a first urging member and a second urging member, wherein the multiple valve elements include at least a first valve element and a second valve element, the first urging member applies the urging force to the first valve element such that the first valve element moves toward the pivoting member, and the second urging member applies the urging force to the second valve element such that the second valve element moves toward the pivoting member, the urging force of the first urging member is greater than the urging force of the second urging member, and the first valve element, to which the urging force is applied by the first urging member, is fixed to the push plate.

7. The electromagnetically driven valve according to claim 6, wherein the second valve element, to which the urging force is applied by the second urging member, is supported by the push plate so as to be movable with respect to the push plate in the direction in which the valve shafts extend, and a valve lift amount of the first valve element differs from a valve lift amount of the second valve element.

8. An electromagnetically driven valve, comprising:

multiple valve elements that have respective valve shafts and reciprocate in a direction in which the valve shafts extend;

a pivoting member that extends from a driving end, which is operatively linked with the valve shafts, to a pivoting end, and that pivots around a central axis which extends along the pivoting end;

a support member that supports the valve elements;

a single push plate that is pressed by the pivoting member, thereby moving the multiple valve elements;

at least first and second urging members, the number of urging members being less than the number of the valve elements, and the first urging member applies an urging force to the push plate such that the push plate moves toward the pivoting member.

9. An electromagnetically driven valve, comprising:

at least two valves that have respective valve shafts, and that alternately open and close by reciprocation of the respective valve shafts, the multiple valve elements comprise at least a first valve element and a second valve element;

a support member;

a pivoting member that has a driving end and a pivoting end, and that is fixed to the support member so as to be pivotable around the pivoting end serving as a pivot axis;

a drive source that causes the pivoting member to pivot around the pivoting axis;

push plate that reciprocates in accordance with a pivot of the pivoting member, and that presses the at least two valve shafts downward, thereby opening the at least two values; and a valve lift amount differs between the first and second valve elements when the pivoting member pivots downward.

10. The electromagnetically driven valve according to claim 9, wherein:

the drive source includes an upper electromagnet that is arranged above the pivoting member; and a lower electromagnet that is arranged below the pivoting member, an electric current is applied alternately to the upper electromagnet and the lower electromagnet in order to cause the upper electromagnet and the lower electromagnet to alternately generate an attraction force for attracting the pivoting member, whereby the pivoting member pivots around the pivot axis.

11. The electromagnetically driven valve according to claim 9, further comprising:

a stem that has a first end which contacts the pivoting member and a second end which contacts the push plate, and that presses the push plate downward as the pivot member moves downward, thereby moving the at least two valve shafts.

12. The electromagnetically driven valve according to claim 11, wherein the second end of the stem is formed in a spherical shape.

13. The electromagnetically driven valve according to claim 9, further comprising:

a pivoting joint mechanism that pivotably connects one of the at least two valve shafts to the push plate; and a fixing portion that fixes the valve shaft, which is connected to the pivoting joint mechanism, at a position at which the valve shaft is moved upward as much as possible.

14. The electromagnetically driven valve according to claim 13, wherein the push plate includes a moving mechanism that can change a position, at which a force is transmitted from the pivoting member to the push plate, in a direction in which the at least two valve shafts are arranged.

15. The electromagnetically driven valve according to claim 9, wherein the push plate includes an inserted member and an inserting member that can slide with respect to each other in a longitudinal direction, the inserted member is pivotably connected to one of the valve shafts, and the inserting member is pivotably connected to the other valve shaft, the push plate further includes a locking mechanism that prevents the inserted member and the inserting member from sliding with respect to each other, and the position, at which the force is transmitted from the pivoting member to the push plate, deviates from a center of the push plate in the longitudinal direction.

16. An electromagnetically driven valve, comprising:

at least two valves that have respective valve shafts, and that alternately open and close by reciprocation of the respective valve shafts;

a support member;

a pivoting member that has a driving end and a pivoting end, and that is fixed to the support member so as to be pivotable around the pivoting end serving as a pivot axis;

a drive source that causes the pivoting member to pivot around the pivoting axis;

push plate that reciprocates in accordance with a pivot of the pivoting member, and that presses the at least two valve shafts downward, thereby opening the at least two valves;

a first urging member that applies an urging force to one of the at least two valve shafts such that the one valve shaft moves toward the pivoting member; and a second urging member that applies an urging force to the other of the at least two valve shafts such that the other valve shaft moves toward the pivoting member, wherein the urging force of the first urging member is greater than the urging force of the second urging member, and the valve shaft, to which the urging force is applied by the first urging member, is fixed to the push plate.

17. The electromagnetically driven valve according to claim 16, wherein the valve shaft, to which the urging force is applied by the second urging member, is supported by the push plate so as to be movable with respect to the push plate in a direction in which the valve shaft reciprocates.

18. The electromagnetically driven valve according to claim 17, wherein the valve shaft, to which the urging force is applied by the second urging member, is supported by the push plate such that, when the push plate is moved downward by a predetermined amount by being pressed by the driving end of the pivoting member, a downward force is applied to the valve shaft.

19. An electromagnetically driven valve, comprising:

at least two valves that have respective valve shafts, and that alternately open and close by reciprocation of the respective valve shafts;

a support member;

a pivoting member that has a driving end and a pivoting end, and that is fixed to the support member so as to be pivotable around the pivoting end serving as a pivot axis;

a drive source that causes the pivoting member to pivot around the pivoting axis;

push plate that reciprocates in accordance with a pivot of the pivoting member, and that presses the at least two valve shafts downward, thereby opening the at least two valves;

an urging member which applies an urging force to the push plate such that the push plate moves toward the pivoting member, and whose number is less than the number of the valve shafts.

* * * * *

UNITED STATES PATENT AND TRADEMARK OFFICE

CERTIFICATE OF CORRECTION

PATENT NO. : 7,418,932 B2
APPLICATION NO. : 11/492872
DATED : September 2, 2008
INVENTOR(S) : Yutaka Sugie et al.

It is certified that error appears in the above-identified patent and that said Letters Patent is hereby corrected as shown below:

| Column | Line | |
|---|---|---|
| 2 | 9 | Change “extend” to --extends--. |
| 8 | 57 | After “clearance” insert --“d”.--. |
| 9 | 57 | Change “prevents” to --prevent--. |
| 11 | 57 | After “it” insert --is--. |
| 12 | 54 | Change “has” to --have-- |
| 13 | 19 | After “amount” insert --that--. |
| 14 | 53 | Before “push plate” insert --a--. |
| 14 | 57 | After “amount” insert --that--. |
| 16 | 3 | Before “push plate” insert --a--. |
| 16 | 41 | Before “push plate” insert --a--. |
| 16 | 44 | After “valves;” insert --and--. |

Signed and Sealed this

Twenty-sixth Day of May, 2009

John Doll

JOHN DOLL
*Acting Director of the United States Patent and Trademark Office*